United States Patent [19]

Stanko

[11] Patent Number: 4,835,053

[45] Date of Patent: May 30, 1989

[54] DARK DYEING YARN CONTAINING POLYESTER FIBERS AND METHOD OF PREPARATION

[75] Inventor: Wayne S. Stanko, Asheville, N.C.

[73] Assignee: BASF Corporation, Williamsburg, Va.

[21] Appl. No.: 124,707

[22] Filed: Nov. 24, 1987

[51] Int. Cl.[4] ..... D02G 3/00

[52] U.S. Cl. ..... 428/364; 264/210.2; 264/210.7; 264/210.8; 264/230; 428/373

[58] Field of Search ..... 428/364, 373; 264/230, 264/176, 210.2, 210.7, 210.8

[56] References Cited

U.S. PATENT DOCUMENTS

| | | | |
|---|---|---|---|
| 4,156,071 | 5/1979 | Knox | 528/308.2 |
| 4,195,051 | 3/1980 | Frankfort et al. | 264/210.2 X |
| 4,491,657 | 1/1985 | Saito et al. | 528/308.1 |
| 4,639,347 | 1/1987 | Hancock et al. | 264/291 |

*Primary Examiner*—Lorraine T. Kendell

*Attorney, Agent, or Firm*—Edward F. Sherer

[57] ABSTRACT

A yarn comprising polyester fibers having an improved combination of properties including darker dyeing capability, good thermal dimensional stability, and good light stability and dye lightfastness can be prepared by drawing and annealing a feeder yarn having a birefringence ($\Delta n$) of at least 0.0175 at carefully controlled temperatures and draw ratios.

1 Claim, 2 Drawing Sheets

DARK DYEING YARN CONTAINING POLYESTER FIBERS AND METHOD OF PREPARATION

BACKGROUND AND SUMMARY OF THE INVENTION

This invention relates to polyester fiber having an improved balance of fiber properties including dyeability, light stability, dye lightfastness, and boiling water shrinkage.

Polyester fibers have been prepared for commercial use for more than thirty years, and are produced in large quantities. Most commercial polyester comprises poly(ethylene terephthalates).

The term "fiber" as used herein includes fibers of extreme or indefinite length (i.e., filaments) and fibers of short length (i.e., staple). The term "yarn", as used herein, means a continuous strand of fibers.

Because fibers produced from polyester have a number of outstanding characteristics: excellent dimensional stability and sturdiness, a high degree of crease resistance, good bulk elasticity, and warm handle, the fibers have found a wide variety of applications, especially in the textile field.

In the past, in order to produce polyester fibers having excellent dyeability, i.e., dark dyed polyester fibers, various chemical additives or modifiers have been employed. A problem associated with the use of these additives or modifiers is that many times they reduce the light stability and dye lightfastness of the resulting fibers.

Another procedure used in the past for producing polyester fibers having excellent dyeability is to produce fibers with high long-period spacing (LPS). A problem associated with fibers produced by this procedure is that, many times, dimensional stability is decreased, which results in high shrinkage of the fibers.

Thus, the combined objective of polyester fibers having excellent dyeability along with good thermal stability and lightfastness become somewhat irreconcilable in many of the commercial processes for producing polyester fibers.

For many commercial applications, it is necessary that polyester fibers must have good thermal stability, i.e., relatively low shrinkage over a large temperature range. While the maximum permissible shrinkage will vary depending on the intended use of the fibers, in many home furnishing and automobile applications, such as body cloth and fabrics containing different yarns in adjacent areas of the same fabric, it is desirable that the fibers of the yarns have a boil-off shrinkage of less than twelve percent (12%).

The present invention provides polyester yarn containing fibers having an improved combination of properties with a darker dyeing capability, good thermal dimensional stability, and good light stability, dye lightfastness, and a method of their preparation which results in a fiber having an overall better combination of properties, i.e., one which involves less sacrifice of one or more individual properties to improve the other.

It has been unexpectedly discovered that yarn comprising poly(ethylene terephthalate) fibers having the above-described combination of properties can be prepared from a partially oriented feeder yarn comprising poly(ethylene terephthalate) fibers having a birefringence ($\Delta n$) of at last 0.0175 by drawing the feeder yarn at controlled temperatures and draw ratios, annealing the drawn yarn at controlled temperatures, and subsequently drawing, a second time, the annealed yarn at controlled temperatures and draw ratios.

The poly(ethylene terephthalate) fibers of the yarn which have been produced by this procedure are characterized by a long-period spacing (LPS) of over 200 Å, an average crystal size of in the range of from about 30 to about 45 Å, and crystallinity of less than 24 percent.

DETAILED DESCRIPTION OF THE PREFERRED EMBODIMENTS

Figure 1:
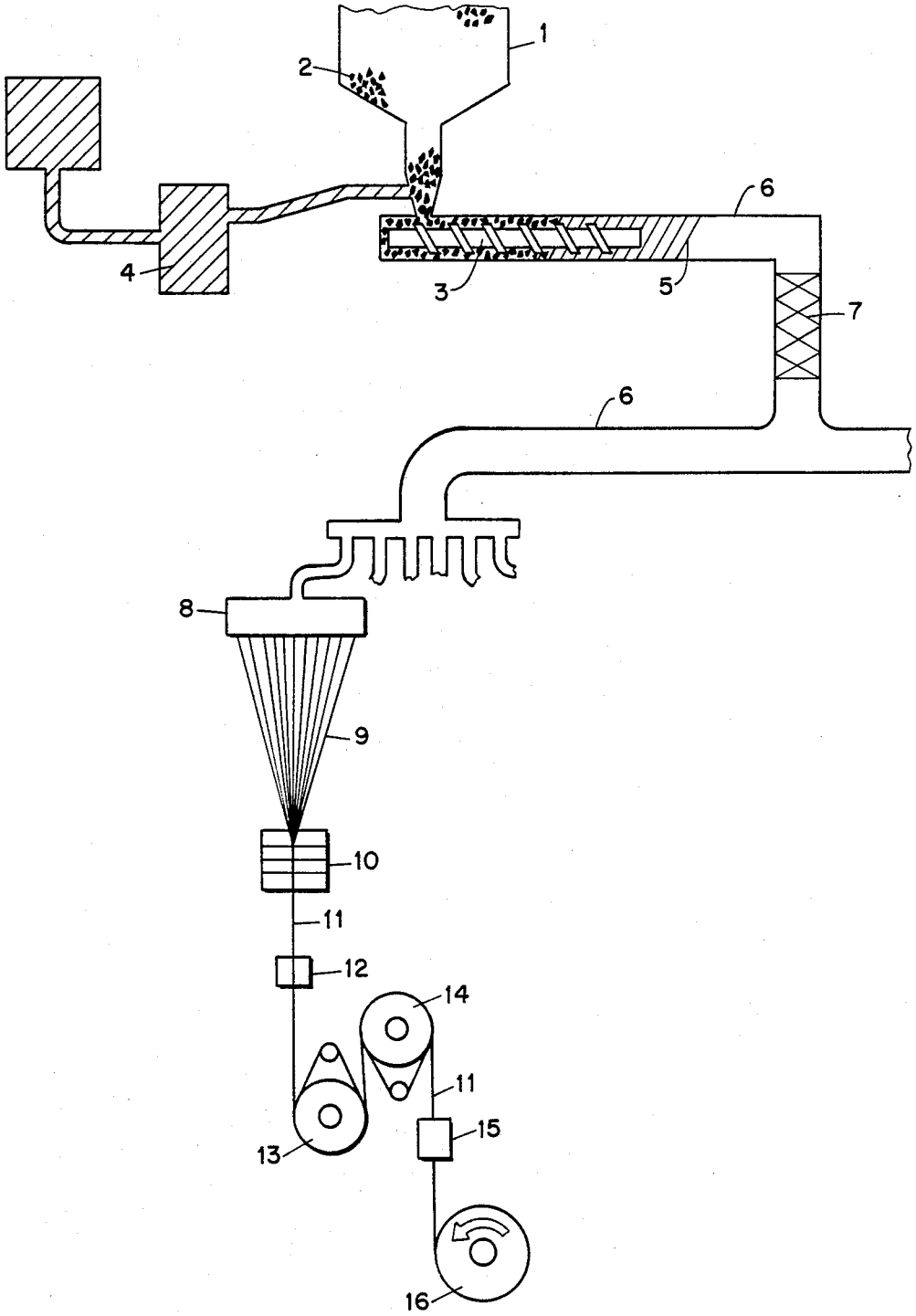
FIG. 1 is a partial schematic of the apparatus and process suitable for preparing the feeder yarn of the invention.

By the term "poly(ethylene terephthalate)", it is meant a linear polyester in which at least about 85% of the recurring structural units are ethylene terephthalate units of the following formula:

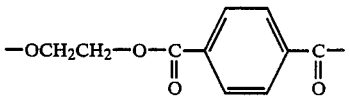

Preferably, the linear polyester contains at least ninety percent (90%) recurring structural units of ethylene terephthalate. In a particularly preferred embodiment of the process, the polyester is substantially all poly(ethylene terephthalate). Up to 15 mol percent of other copolymerizable ester units other than poly(ethylene terephthalate) can also be present, as long as their effect does not appreciably decrease the light stability and dye lightfastness of the resulting filaments.

Preferably, the yarn comprising poly(ethylene terephthalate) fibers having the improved combination of properties can be produced by the following procedure:

(a) draw a feeder yarn having a birefringence ($\Delta n$) of at least 0.0175 at ambient temperature, i.e., in the range of from about 20° to about 25° C., and a draw ratio in the range of from 1.0089 to about 1.15;

(b) anneal the drawn feeder yarn of step (a) at a temperature in the range of from about 75° to about 100° C.; and, (c) draw the annealed feeder yarn of step (b) at a temperature in the range of from about 100° to about 120° C., and a draw ratio in the range of from about 1.4 to about 1.9.

Preferably, the drawing of the feeder yarn of step (a) is carried out at a draw ratio of about 1.009.

The temperature of the annealing of step (b) is preferably in the range of from about 85° to about 100° C. and, more preferably, at about 95° C.

The drawing of the yarn of step (c) is preferably carried out with a draw ratio in the range of from about 1.8 to about 1.87, more preferably at about 1.84 and, preferably, at a temperature in the range of from about 105° to about 115° C. and, more preferably, at about 105° C.

Any suitable procedure can be utilized to prepare the feeder yarn used in the invention. A preferred procedure comprises the following steps:

(a) extrude molten poly(ethylene terephthalate having an intrinsic viscosity in the range of from about 0.40 to about 0.8, and preferably 0.64, through a spinneret to form one or more fibers;

(b) quench said fibers, preferably to a temperature not exceeding 40° C. higher than the glass transition of the poly(ethylene terephthalate);

(c) optionally, apply to said fibers of step (b) a lubricating finish in an amount in the range of from about 0.1 to about 1.0 weight percent based on the weight of the yarn; and, (d) take up said quench fibers of step (b) or (c) at a take-up speed sufficient to partially orient fibers in an amount sufficient to achieve a birefringence in said fibers of at least 0.0175, preferably at least 0.020, which generally is a speed in the range of from about 2,200 meters/ minute to about 3,000 meters/minute and, more preferably, 2,700 meters/minute to 2,800 meters/minute.

The yarns comprising poly(ethylene terephthalate) fibers can be processed into fabrics which will generally be processed into garments or upholstery, such as for automobiles.

Various characteristics and measurements are utilized throughout the application. These characteristics and measurements are grouped here for convenience, although most are standard.

Density measurements are obtained by means of a density gradient column.

Percent crystallinity of the filaments is obtained from the following formula:

$$Xc = 100 \cdot \frac{\rho c}{\rho}\left(\frac{\rho - \rho a}{\rho c - \rho a}\right)$$

where $\rho$=sample density $\rho a$=amorphous density of polyester $\rho c$=crystalline polyester density Long-period spacing is obtained by small-angle x-ray scattering (SAXS) patterns made by known photographic procedures. X-radiation of a known wavelength, e.g., $CuK_a$ radiation having a wavelength of 1.5418 A, is passed through a parallel bundle of filaments in a direction perpendicular to the filament axis, and the diffraction pattern is recorded on photographic film.

Birefringence ($\Delta n$) is obtained in the following manner:

Sodium D rays (wavelength 589 millimicrons) are used as a light source, and the filaments are disposed in a diagonal position. The birefringence ($\Delta n$) of the specimen is computed from the following equation:

$$\Delta n=(n\lambda+r/\alpha)$$

when n is the interference fringe due to the degree of orientation of the polymer molecular chain; r is the retardation obtained by measuring the orientation not developing into the interference fringe by means of a Berek's compensator; $\alpha$ is the diameter of the filament; and $\lambda$ is the wavelength of the sodium D rays.

The crystal size (L) is a value obtained in accordance with the following (P. Scherrer's) equation, which represents the size of a crystal in a direction approximately at right angles to the fiber axis:

$$L(A)=\lambda K/(B-b)\cos\theta$$

wherein

B is a (010) diffraction peak width in radian unit when the diffraction intensity is (It+Iam)/2, in which It is a diffraction intensity at (010) peak position, and Iam is a meridional X-ray diffraction intensity at a Bragg's reflection angle of $2\theta=17.7°$;

b is 0.00204 radian;

K is 0.94; and, $\lambda$ is 1.542 A.

The term "shrinkage of the fibers in boiling water" is defined as "percent decrease in length of material when exposed to elevated temperatures for a period of time and under 0.05 g.p.d. tension". In the present invention, the percent thermal shrinkage is measured in a boiling water bath of 100° C. for a period of 30 minutes. The shrinkage of the fiber is determined in accordance with the following formula:

$$\text{Shrinkage}=(L_1-L_2/L_1)\times 100$$

wherein:

$L_1$ is original length of fiber; and, $L_2$ is length of fiber after treatment.

Throughout the present specification and claims, the intrinsic viscosity of the polyester melt is given as a measure for the mean molecular weight, which is determined by standard procedures wherein the concentration of the measuring solution amounts to 0.5 g./100 ml., the solvent is a 60 percent by weight phenol/40 percent by weight tetrachloroethane mixture, and the measuring temperature is 25° C.

The tenacity or breaking strength in grams per denier (UTS) is defined by ASTM Standards, part 24, American Society for Testing and Materials, 1916 Race Street, Philadelphia, PA., page 33 (1965) as "the maximum resultant internal force that resists rupture in a tension test," or "breaking load or force, expressed in units of weight required to break or rupture a specimen in a tensile test made according to specified standard procedure".

The photocell test value is obtained by first knitting yarn into a hoseleg using a Lawson Hemphill 54 gauge Fiber Analysis Knitter. The hoseleg is then dyed in a bath containing 1.2% by weight, based on fabric weight, of color index blue disperse 27 and 1.5% by weight of palegal MB-SF leveling agent. The bath is raised to 130° C. over a 45 minute period and held at 130° C. for 30 minutes. After drying, the hoseleg is placed on a flat surface and folded double. The measuring head of a Photovolt Model 670 Reflection Meter is placed on the hoseleg. A reflectance value is determined. A control sample is used to calibrate the reflection meter at 50. Reflection values below 50 indicate darker dyeing.

The dye level of a yarn can also be determined by testing it on a Toray FYL dye analyzer. The main components are an FYL continuous dyeing unit, Model 541, and a FYL Analyzer, Model 551. As the yarn passes through the continuous dyeing unit at 20 meters/minute, it proceeds through a scouring bath, dyeing bath, and rinsing bath. Bath temperatures and residence times are shown below.

| | Temperature, °C. | Residence Time, Minutes |
|---|---|---|
| Scour | 70 | 1 |
| Dye | 90 | 3 |

-continued

| | Temperature, °C. | Residence Time, Minutes |
|---|---|---|
| Rinse | 85 | 0.5 |

After leaving the continuous dyeing unit, the yarn enters the FYL Analyzer, where the yarn is presented to a reflectance meter. Multiple reflection measuerments are made on 10 meters of yarn as it passes through the reflectance meter. A standard yarn of known dye level is used to calibrate the reflectance meter to zero. Dye level of the samples is compared to the standard. A negative value indicates lighter dyeing relative to the standard yarn.

Figure 2:
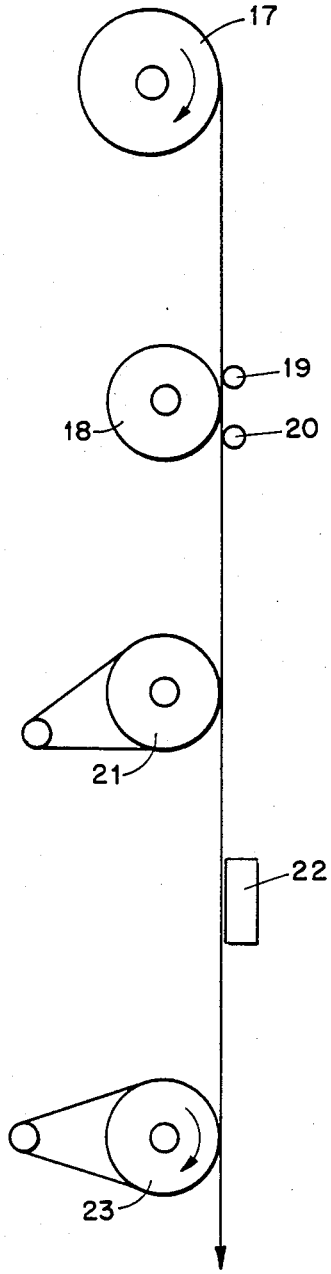
FIG. 2 is a partial schematic of an apparatus and process suitable for the anneal/draw process of the invention.

The apparatus and process are represented schematically in FIG. 1 and FIG. 2. With respect to FIG. 1, a method of preparing feeder yarn having a birefringence ($\Delta n$) of at least 0.0175 is illustrated. The method comprises first supplying a chip hopper 1 with chips comprising poly(ethylene terephthalate) 2. The hopper 1 in turn supplies an extruder 3 with the chips 2. An additive pump 4 is also illustrated whereby various liquid additives such as pigments or heat stabilizers can be added, if desired, to the chip stream which is entering the extruder 3. Once the chips exit the extruder as a molten stream 5, the stream is pumped through a conduit 6 which contains a plurality of static mixers 7. Once through the static mixers 7, the mix stream enters the spinneret 8 and is extruded into a plurality of molten streams 9 which are solidified in a quench chamber 10. The quench chamber is generally an elongated chimney of conventional length, preferably 60 to 80 inches, which has a gaseous atmosphere below the glass transition temperature of the molten polyester. The solidified fibers 11 next pass over an applicator 12 whereby the fibers are lubricated. Lubricants suitable for such use are known to those skilled in the art and include mineral oil, butyl stearate, alkoxylated alcohols, and phosphates or cationic antistatic compositions. The fibers next travel around a first (upstream) powered godet 13 and then around a second (downstream) godet 14, following which the yarn 11 is interlaced by an interlacer 15. Lastly, the filaments are wound into a bobbin 16. The filaments at this point are generally referred to as feeder yarn.

The speed at which the spun fibers are wound must be in the range of from about 2,200 to about 3,000 meters per minute and, preferably, about 2,750 meters per minute.

Referring to FIG. 2, the feeder yarn is fed continuously from package 17 by feed roll 18 by means of guides 19 and 20. The yarn is taken up and drawn at a point between a first godet 21 and feed roll 18 by means of the first godet 21. The yarn is drawn at a draw ratio in the range of from about 1.0089 to about 1.15, most preferably about 1.009, and at ambient temperatures, i.e. 20° to 25° C. Next, the yarn is heated (annealed) by means of heated godet 21 to a temperature in the range of from about 75° to about 100° C. and, more preferably, 85° to about 95° C. The annealed yarn is next taken up and drawn by means of a second godet 23 at a draw ratio in the range of from about 1.4 to about 1.9, more preferably 1.80 to about 1.87, and further heated by heater 22 to a temperature in the range of from about 100° C. to about 120° C., and more preferably, from about 100° to about 115° C. At this point, the yarn is ready to be wound on a pirn (not shown).

The filament yarn produced in accordance with the invention usually has a denier per filament of 1 to 20. Total denier of the yarns produced in accordance with the invention generally range from about 40 to about 200 denier and, preferably, from about 70 to about 150 denier.

The invention is further exemplified by the examples below, which are presented to illustrate certain specific embodiments of the invention, but are not intended to be construed so as to be restrictive of the scope and spirit thereof.

EXAMPLE I

Feeder yarns comprising polyethylene terephthalate were prepared under the following spinning and winding conditions set forth in Table I.

TABLE I

| | |
|---|---|
| Spinneret | 24 hole, 100 × 600 × 600 × 600 μm |
| Spinning Temperature, Degrees C. | 285 |
| Spinning Output, grams/min. | 30.0 |
| Blowbox Air Flow, ft.$^3$/min. | 175 |
| Standard Finish Concentration | 14% |

One of the feeder yarns, hereinafter designated FY-A, was wound at 1,600/min. A second feeder yarn hereinafter designated FY-B was wound at 2,800 m/min.

The feeder yarns were processed under the conditions set forth in Table II.

TABLE II

| Yarn | Draw Speed (m/min.) | Draw Ratio First Draw | Draw Ratio Second Draw | Godet Temperature °C. | Annealing Temperature °C. |
|---|---|---|---|---|---|
| FY-A | 594 | 1.009 | 2.9 | 84 | 120 |
| FY-B | 594 | 1.009 | 1.4 | 79 | 120 |

The results of these tests are shown in Table III.

TABLE III

| Sample | Cross Section | Denier | Tenacity (g/denier) | Elongation (%) | Boiling Water Shrinkage (%) | Dye Value Photocell | Dye Value Toray | LPS (Å) | Crystal Size Å Direction 010 | 110 | 100 | 105 |
|---|---|---|---|---|---|---|---|---|---|---|---|---|
| FY-A | Triangular | 70 | 4.8 | 19 | 10 | 50.0 | 0.13 | 146 | 41.1 | 39.1 | 31.2 | 59.1 |
| FY-B | Triangular | 68 | 3.2 | 48 | 5.9 | 39.7 | −8.29 | 209 | 36.1 | 41.7 | 29.3 | 50.1 |

The results of these tests show that the yarns of the invention have a darker dyeing capability and low boiling water shrinkage.

The long period spacing (LPS) was larger for FY-B. Since dye is absorbed into this region, the yarn dyed darker than FY-A with the shorter LPS. Surprisingly, however, FY-B, despite its larger LPS, had a dye lightfastness and light stability equal to FY-A.

EXAMPLE II

Feeder yarns produced in the same manner as Example I were processed according to the conditions set forth in Table IV below.

TABLE IV

| Sample | Yarn Cross Section | Yarn Luster | Spinning Output (g/mm) | Winding Speed (m/mm) | Drawing Speed (m/mm) | Draw Ratio First Draw | Draw Ratio Second Draw | First Godet Temperature °C. | Annealing Temperature °C. |
|---|---|---|---|---|---|---|---|---|---|
| A | Triangular | Semi-dull | 30.0 | 2,800 | 594 | 1.009 | 1.4 | 79 | 120 |
| B | Round | Bright | 34.0 | 2,800 | 1,105 | 1.009 | 1.77 | 95 | 105 |
| C | Round | Bright | 38.5 | 2,725 | 847 | 1.009 | 1.87 | 95 | 105 |

The properties of the yarns obtained at these conditions are shown in Table V.

TABLE V

| Sample | Denier | Tenacity (g/den) | Elongation (%) | Boiling Water Shrinkage (%) | Photocell Value | Toray Value |
|---|---|---|---|---|---|---|
| A | 68 | 3.2 | 48 | 5.9 | 39.7 | −8.29 |
| B | 70 | 4.3 | 38 | 11.8 | 34.0 | −4.02 |
| C | 70 | 4.5 | 38 | 11.9 | 35.0 | −4.12 |

The results of these tests demonstrate that yarns produced in accordance with the invention result in yarn having an improved combination of properties, including a darker dyeing capability and good thermal dimensional stability.

Although certain preferred embodiments of the invention have been described for illustrative purposes, it will be appreciated that various modifications and innovations of the procedures and compositions recited herein may be effected without departure from the basic principles which underlie the invention. Changes of this type are therefore deemed to lie within the spirit and scope of the invention except as may be necessarily limited by the amended claims or reasonable equivalents thereof.

What is claimed is:

1. A dark dyeing yarn comprising annealed poly(ethylene terephthalate) fibers having an improved combination of properties, said fibers characterized by a long-period spacing of over 200Å, an average crystal size in the range of from about 30 to about 45 Å, a crystallinity of less than 24 percent, and a boiling water shrinkage of less than about 12%.

* * * * *